US007108149B2

(12) United States Patent
Taylor et al.

(10) Patent No.: US 7,108,149 B2
(45) **Date of Patent: *Sep. 19, 2006**

(54) BLOW-MOLDED PAINT CONTAINER

(75) Inventors: Dale W. Taylor, Hamilton, IN (US); Douglas M. McLelland, Ft. Wayne, IN (US)

(73) Assignee: Rieke Corporation, Auburn (IN)

( * ) Notice: Subject to any disclaimer, the term of this patent is extended or adjusted under 35 U.S.C. 154(b) by 67 days.

This patent is subject to a terminal disclaimer.

(21) Appl. No.: 10/925,019

(22) Filed: Aug. 24, 2004

(65) Prior Publication Data

US 2005/0017008 A1 Jan. 27, 2005

Related U.S. Application Data

(63) Continuation of application No. 10/394,958, filed on Mar. 21, 2003, now Pat. No. 6,854,617.

(51) Int. Cl.
*B65D 41/04* (2006.01)

(52) U.S. Cl. ..... 220/288; 220/495.02; 215/202

(58) Field of Classification Search ..... 220/288, 220/459.02, 267, 277, 278, 203.13, 495.02; 215/202, 257, 231, 305, 302, 343, 341, 349, 215/363

See application file for complete search history.

(56) References Cited

U.S. PATENT DOCUMENTS

| | | | | |
|---|---|---|---|---|
| 1,632,848 A | | 6/1927 | Prahl | |
| 1,694,165 A | | 12/1928 | Debacher | |
| 1,835,541 A | | 12/1931 | Tompkins | 222/83 |
| 3,045,854 A | * | 7/1962 | Patton | 215/260 |
| 3,275,366 A | | 9/1966 | Hidding | 294/31.2 |
| 3,586,200 A | | 6/1971 | Kramer | 220/94 |
| 4,066,182 A | * | 1/1978 | Allen et al. | 215/256 |
| 4,121,728 A | * | 10/1978 | Tagalakis et al. | 215/260 |
| 4,201,311 A | * | 5/1980 | Underwood | 220/780 |
| 4,245,753 A | | 1/1981 | Ellis | 220/288 |
| 4,298,134 A | * | 11/1981 | Lewis, Jr. | 220/792 |
| 4,353,489 A | | 10/1982 | Arnold et al. | 222/570 |
| 4,399,926 A | | 8/1983 | Eidels-Dubovoy | 220/288 |
| 4,453,647 A | | 6/1984 | Neat | 220/288 |
| 4,550,862 A | | 11/1985 | Barker et al. | 222/109 |
| 4,619,373 A | * | 10/1986 | Galer | 220/783 |
| 4,671,421 A | | 6/1987 | Reiber et al. | 215/228 |
| 4,673,625 A | | 6/1987 | McCartney et al. | 429/187 |
| 4,706,829 A | | 11/1987 | Li | 215/354 |
| 4,736,874 A | | 4/1988 | Durant | 222/570 |
| 4,793,503 A | | 12/1988 | Towns et al. | 215/250 |
| 4,856,673 A | | 8/1989 | Thompson | 220/94 R |
| 4,893,723 A | | 1/1990 | Seabolt | 220/85 SP |
| 4,974,749 A | | 12/1990 | Mon | 222/111 |
| 4,984,714 A | | 1/1991 | Sledge | 222/109 |

(Continued)

*Primary Examiner*—Lien M. Ngo
(74) *Attorney, Agent, or Firm*—Woodard, Emhardt, Moriarty, McNett & Henry LLP

(57) ABSTRACT

A blow-molded, plastic paint container for storing and dispensing paint includes a blow-molded container body defining an externally-threaded neck portion, an injection molded plastic closing cap, internally-threaded so as to be threadedly securable to the neck portion for closing the container body, a liner assembled into the closing cap and a depending annular wall positioned between the neck portion and the liner in order to cause any paint skin that forms to be formed into two portions, one portion being adjacent to the liner and the other portion being adjacent to the container body. Each paint skin portion adhering to its corresponding structural portion of the paint container and remaining intact. In a related embodiment, the annular wall is replaced with three cutting blades.

9 Claims, 6 Drawing Sheets

U.S. PATENT DOCUMENTS

| | | | | |
|---|---|---|---|---|
| 4,993,605 | A | 2/1991 | Del'Re | 222/545 |
| 5,036,991 | A | 8/1991 | Wallman | 215/256 |
| 5,058,772 | A | 10/1991 | Moore et al. | 222/109 |
| 5,082,136 | A | 1/1992 | Schumann | 220/278 |
| 5,108,009 | A | 4/1992 | Davidson et al. | 222/109 |
| 5,188,249 | A | 2/1993 | Cargile | 215/31 |
| 5,228,596 | A | 7/1993 | McNally | 222/109 |
| 5,234,130 | A | 8/1993 | Benioff et al. | 222/111 |
| 5,251,788 | A | 10/1993 | Moore | 222/111 |
| 5,269,438 | A | 12/1993 | Kelsey | 220/766 |
| 5,344,041 | A | 9/1994 | Luburic et al. | 220/760 |
| 5,381,914 | A * | 1/1995 | Koyama et al. | 215/341 |
| 5,431,306 | A | 7/1995 | Reid | 222/111 |
| 5,435,467 | A | 7/1995 | Ekkert et al. | 222/109 |
| 5,457,850 | A | 10/1995 | Knox | 16/114 R |
| 5,462,202 | A | 10/1995 | Haffner et al. | 222/109 |
| 5,472,121 | A | 12/1995 | Silano | 222/158 |
| 5,477,972 | A | 12/1995 | Lester | 215/230 |
| 5,505,326 | A | 4/1996 | Junko | 220/278 |
| 5,566,862 | A | 10/1996 | Haffner et al. | 222/111 |
| 5,597,090 | A | 1/1997 | Leahy | 222/1 |
| 5,603,787 | A | 2/1997 | Reid | 156/73.1 |
| 5,624,772 | A | 4/1997 | Mc Vey et al. | 429/187 |
| 5,669,526 | A | 9/1997 | Keyfauver | 220/696 |
| 5,762,217 | A | 6/1998 | Ohmi et al. | 215/253 |
| 5,816,439 | A | 10/1998 | Lovell et al. | 220/760 |
| 5,855,304 | A | 1/1999 | Dean et al. | 222/481 |
| 5,941,422 | A | 8/1999 | Struble | 222/109 |
| 6,126,048 | A | 10/2000 | Bublitz | 222/570 |
| 6,209,762 | B1 | 4/2001 | Haffner et al. | 222/570 |
| 6,257,440 | B1 | 7/2001 | Perkins et al. | 220/764 |
| 6,269,949 | B1 | 8/2001 | Gottlieb | 206/519 |
| 6,269,977 | B1 | 8/2001 | Moore | 222/143 |
| 6,543,635 | B1 * | 4/2003 | Ciccone | 220/276 |
| 6,854,617 | B1 * | 2/2005 | Taylor et al. | 220/288 |
| 2001/0025865 | A1 | 10/2001 | Bravo et al. | 222/465.1 |

* cited by examiner

BLOW-MOLDED PAINT CONTAINER

REFERENCE TO RELATED APPLICATION

The present application is a continuation patent application of U.S. patent application Ser. No. 10/394,958, filed Mar. 21, 2003 and now U.S. Pat. No. 6,854,617, entitled "BLOW-MOLDED PAINT CONTAINER" which is hereby incorporated by reference in its entirety.

BACKGROUND OF THE INVENTION

The present invention relates in general to the design and construction of a blow-molded, plastic paint container having a threaded, screw-on cap. More specifically, the present invention relates to the design and construction of a paint container that includes a screw-on cap design with means to sever an interior paint skin extending between the inner surface of the cap and the inner surface of the container body. In a related embodiment of the present invention, the screw-on cap includes a partitioning wall that causes any paint skin to form in two separate portions, one associated with the cap and one associated with the container body.

Many paints are prone to exhibit a "skinning" effect when exposed to air, wherein a firm skin forms over the softer or less viscous "under" paint. While the skinning effect can be seen in oil paints on a palette, it is also common with interior and exterior house paints, whether oil-based or latex. When a conventional one gallon can or container of house paint is opened for use and then resealed after use by tightly pressing the lid back into the receiving groove, air becomes trapped inside. This trapped air contributes to the formation of a skin over the remaining paint in the container. When the container is re-opened for use, the skin needs to be removed so that it is not dispersed into the paint. If the skin is dispersed into the paint, it can be applied to the painted surface and thereby adversely affect the finished quality in terms of smoothness of the paint on the surface. As a result, some devices have been offered to try and eliminate, or at least lessen, the skinning effect. Various techniques or methods of use have also been proposed to eliminate or lessen the skinning effect.

Understanding the skinning effect and what occurs when paint containers are initially opened and then sealed closed has prompted consideration by paint companies and container manufacturers of what occurs when paint containers are initially filled and sealed closed. Considering the range of container sizes, often ranging from one gallon to one quart, and considering the material options, such as various metals and various plastics, does a skin form over or around the paint as received from the manufacturer or filler?

While it is possible to have some small amount of air trapped in the paint container as it is being initially filled and sealed closed, any skinning would be expected to be minimal. However, in an attempt to hopefully eliminate any risk that any paint skin that does form will not be dispersed into the paint, the inside surface of the lid for many metal, one-gallon paint containers includes a surface texturing or coating. This texturing or coating causes the skin (of the paint) to adhere to the lid. As a result, when the lid is removed, the skin portion that is adjacent the lid is also removed and is therefore not at risk for falling off or dropping back into the paint container. While such surface texturing or coating may be a viable option for metal containers when considering the style and configuration of the metal lids and how those lids seal the container closed, a question was raised as to whether these same techniques would be suitable for plastic paint containers, and particularly those having screw-on lids or caps, such as one-quart, blow-molded, plastic paint containers. The present invention addresses this question.

The present invention is directed to a one-quart, plastic paint container with an internally-threaded, screw-on cap. While this represents the preferred embodiment of the present invention, it should be noted that the invention embodiments disclosed herein would be applicable to virtually any type or size of paint container having a screw-on cap. The present invention would presumably also be applicable to containers for any other substance that demonstrates a similar likelihood for skinning.

In studying the known technology used for metal paint containers with metal lids, the present inventors discovered that a rough surface, polyfoam liner assembled into the plastic cap causes the paint to adhere to that liner, similar to what occurs with a coated metal lid. Ideally, when the cap is first removed, any paint skin that may have been formed adjacent to the cap would come off with the cap, adhering to the liner, and therefore not break up or fragment such that portions of the paint skin would fall off or drop back into the paint in the container.

What has been discovered by the present inventors is that the current design of the one-quart, blow-molded plastic paint container has a small head space that allows a paint skin to form adjacent the inside of the container and adjacent the inside of the cap or lid. When the cap is initially removed (unscrewed), the paint skin that laps over the container-to-cap interface can tear and paint skin fragments can break off and drop back into the paint container. This becomes a second problem to solve, the first problem being the selection of a suitable coating or a liner for the cap in order to get some portion of the paint skin to adhere to the cap. Using a cap liner to which the paint skin adheres captures a portion of the paint skin, lessening, but not necessarily eliminating, the chances of skin fragments breaking off and dropping back into the paint.

The present invention solves this second problem in a novel and unobvious way by adding a dividing or partitioning wall as part of the cap such that the paint skin forms in two separate portions, one on each side of the partitioning wall. One paint skin portion adheres to the cap liner and is removed intact with the cap. The other paint skin portion adheres to the inner surface of the container body and remains intact with the container body wall.

In a second embodiment of the present invention, the partitioning wall is replaced by a set of equally-spaced cutting blades. Since there are open spaces between these cutting blades, the paint skin is formable through these spaces, extending from the liner to the container neck opening. While the paint skin still adheres to the liner and to the inner surface of the container body, the portions of the paint skin that extend through the clearance openings between adjacent cutting blades need to be severed and this is the function of the cutting blades as the cap is unscrewed.

In this way, the paint skin portion that adheres to the cap remains with the cap and the paint skin portion that adheres to the container body remains with the container body. These two paint skin portions stay adhered to their corresponding packaging portions and do not fragment, break up, or peel off and drop back into the paint.

SUMMARY OF THE INVENTION

A paint container for storing and dispensing paint according to one embodiment of the present invention comprises a container body defining a neck portion, a closing cap constructed and arranged to be securable to the neck portion for closing the container body, a liner assembled into the closing cap, and partitioning means positioned between the neck portion and the liner for causing any paint skin that forms to be formed into two portions, one portion adjacent the liner and the other portion adjacent the container body.

In a related embodiment of the present invention, severing means are provided, forming a portion of the closing cap for segmenting a paint skin formed on the interior of the paint container into a container body skin portion and a closing cap skin portion.

One object of the present invention is to provide an improved plastic paint container.

Related objects and advantages of the present invention will be apparent from the following description.

DESCRIPTION OF THE PREFERRED EMBODIMENTS

Figure 1:
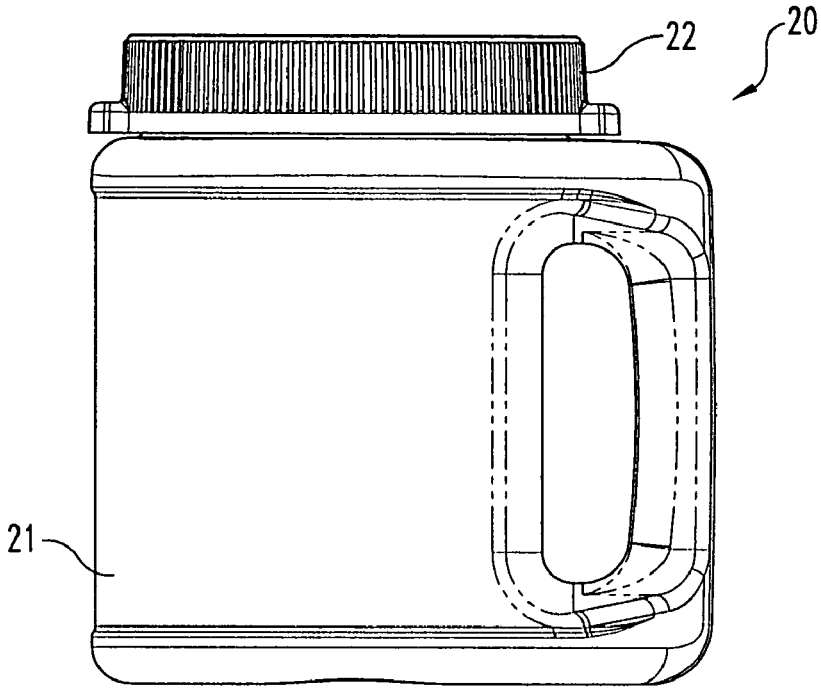
FIG. 1 is a side elevational view of a blow-molded, plastic paint container according to a typical embodiment of the present invention.
Figure 2:
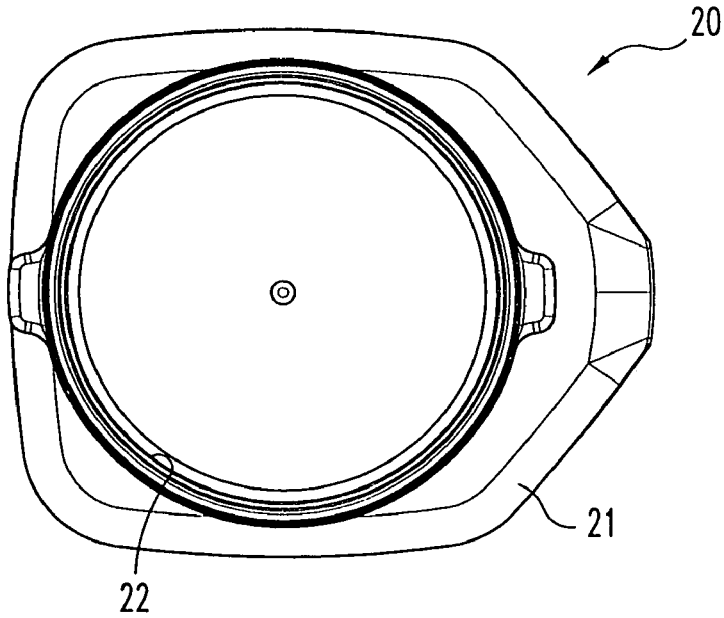
FIG. 2 is a top plan view of the FIG. 1 paint container.
Figure 3:
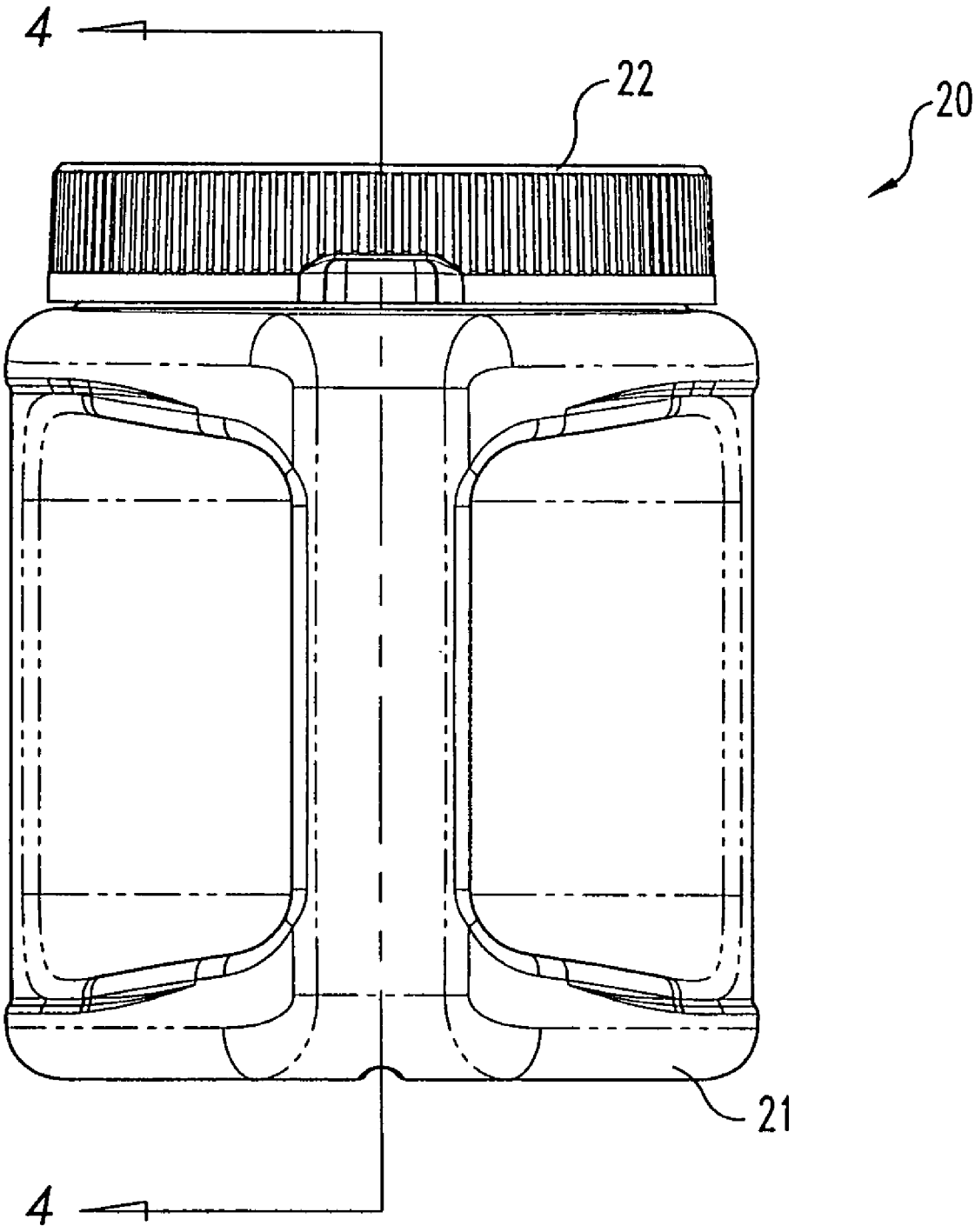
FIG. 3 is a rear elevational view of the FIG. 1 paint container.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1–5, there is illustrated a blow-molded, plastic paint container 20 that is constructed and arranged according to one embodiment of the present invention. Container 20 includes a blow-molded container body 21 and an internally-threaded screw-on cap 22. The container body 21 includes an annular, externally-threaded neck portion 23 that defines cylindrical opening 24, through which paint is dispensed. The container body is preferably fabricated from polyethylene or a similar plastic material. Cap 22 is preferably injection molded from polypropylene or a similar plastic material. The threaded configuration neck portion 23 is compatible with the threaded configuration of cap 22 for the secure threaded assembly of the cap 22 onto the neck portion 23 so as to securely close and seal the container and thereby prevent the leakage of any liquid, such as paint, that is stored in container 20.

Included as part of cap 22 is a polyfoam liner 28 in the form of a relatively thin disk. The exposed surface 29 of liner 28 has a rough texture and provides a material and a texture that are compatible to cause a portion of any paint skin formed within container 20 and adjacent to liner 28 to adhere to the liner. It is known that the minimal volume of air trapped in paint containers at the time of initial filling and sealing closed likely causes a paint skin to develop inside the container. It has been learned that with a blow-molded plastic container of the type described herein as part of the preferred embodiment, and with a cap liner, such as liner 28, the portion of the paint skin that is adjacent the liner 28 adheres to the liner. It has also been learned that the portion of the paint skin that is adjacent the container body 21, typically neck portion 23, adheres to the inside surface of the container body 21. The issue addressed by the present invention focuses on the fact that the paint skin is typically a single, somewhat continuous skin, without any discrete sections or portions that are separate or independent from the skin as a whole. This means that without the present invention, the paint skin would likely bridge across the interface between the cap liner 28 and the container neck portion 23. Then, when the cap is unscrewed, this "bridge" portion can fragment and pieces of the paint skin can drop into the paint.

Figure 6:
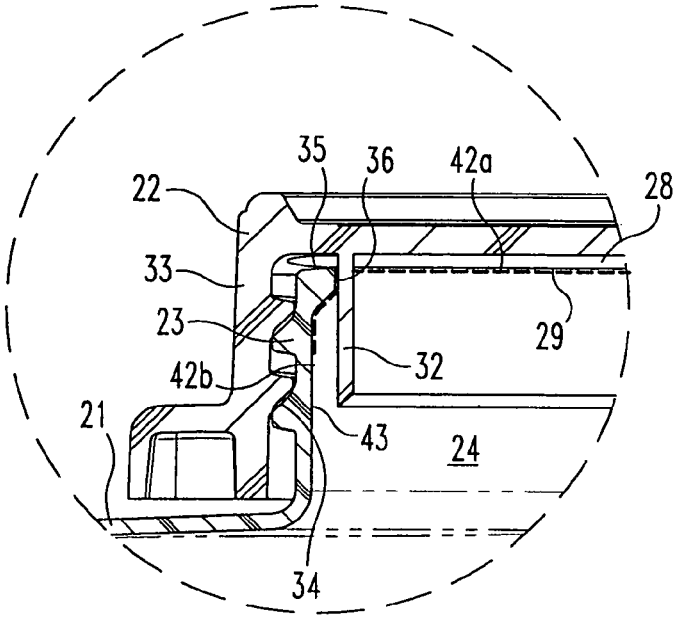
FIG. 6 is an enlarged, partial detail of the corresponding portion of the FIG. 1 paint container as identified in FIG. 4.
Figure 4:
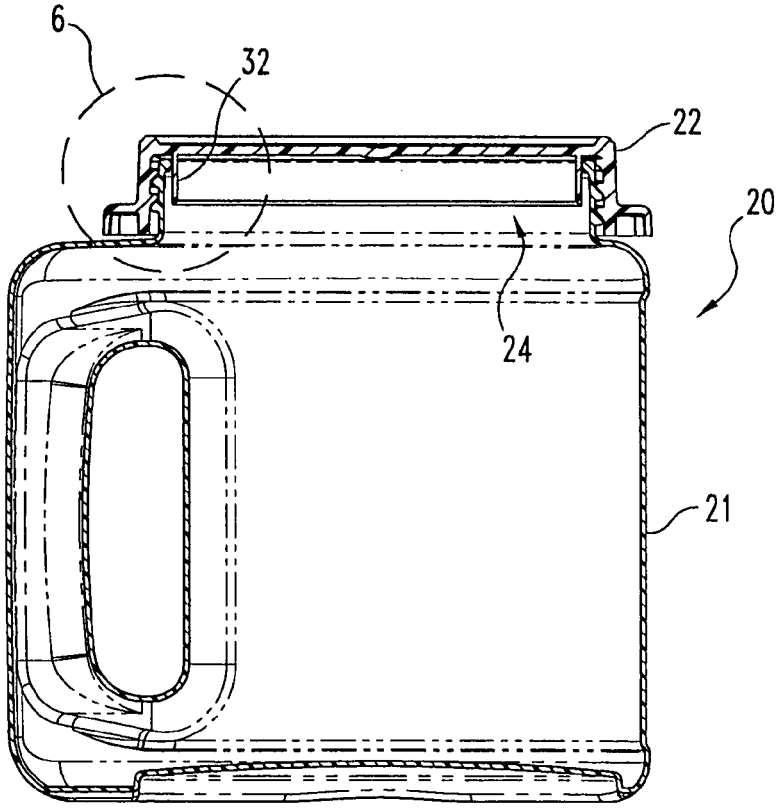
FIG. 4 is a side elevational view, in full section, of the FIG. 3 paint container as viewed along cutting plane 4—4 in FIG. 3.
Figure 5:
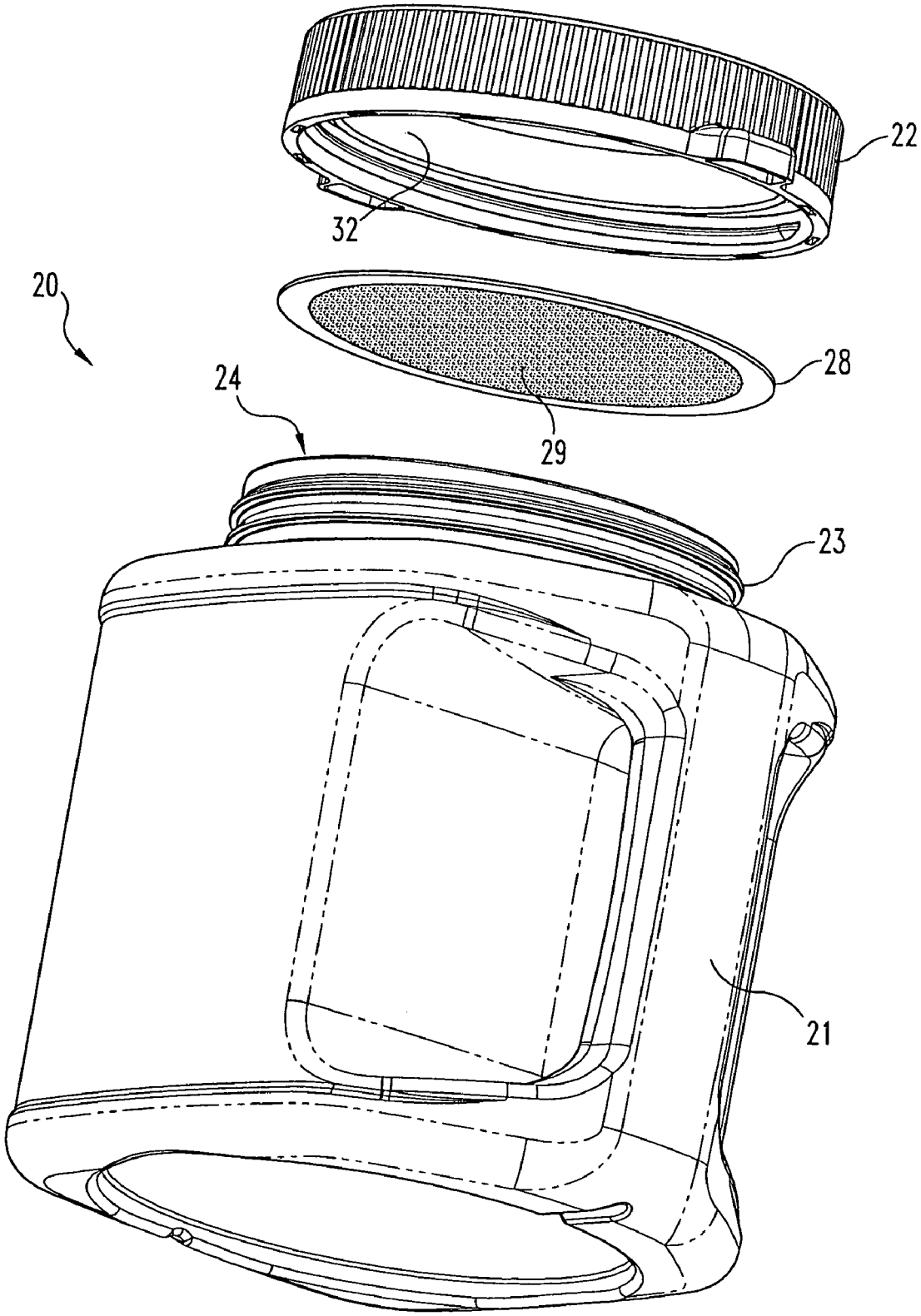
FIG. 5 is an exploded view of the FIG. 1 paint container.

With reference to FIGS. 4 and 6, a first configuration for a suitable paint skin partitioning means is illustrated in the form of an annular bore seal-type wall 32 or what might be referred to as a cork seal. This annular wall 32 which provides for the partitioning between the container and the liner is integrally molded as part of cap 22 and is generally concentric with the outer wall 33 and with the internally-threaded surface 34 of cap 22. This in turn positions the partitioning wall 32 generally concentric with the annular upper surface 35 of neck portion 23. In fact, wall 32 is axially extending and is aligned with the innermost, generally cylindrical surface 36 of neck portion 23 such that there is a close fitting, telescoping relationship between partitioning wall 32 and surface 36, as is illustrated.

The partitioning wall 32 is continuous and integrally joined as part of the cap inner surface outwardly of liner 28, without any openings or separation gaps, thereby partitioning the span or interface between the liner 28 and the container neck portion 23. While the liner 28 is purposefully designed for the paint skin to adhere to it, the partitioning wall 32 is not designed for the paint to adhere to it. The blow-molded container body also provides an inner surface to which the paint skin will adhere. The result of using the partitioning wall 32 to which the paint does not adhere means that any paint skin that forms inside of container 20 will form in two separate portions.

The broken lines 42*a* and 42*b* in FIG. 6 are intended to diagrammatically represent the paint skin portions that are capable of forming in the paint container 20 due to air that is trapped in the head space between the filled volume of paint and the container body, including liner 28 of cap 22. While this head space volume is minimal, whether in actual terms or in view of the initial volume of paint (a one quart container of paint), there is still some small volume of air that can be trapped. Due to the use of partitioning wall 32, any paint skin that forms, forms in two portions, one portion diagrammatically and partially illustrated by broken line 42*a*, the other portion diagrammatically and partially illustrated by broken line 42*b*. As has been described, paint skin portion 42*a* adheres to liner 28 as cap 22 is removed from the container body. Paint skin portion 42*b* remains with the container body since this paint skin portion adheres to the inner surface 43 of the container body 21.

As cap 22 is unscrewed from neck portion 23 in order to dispense the paint contents of container body 21, it has been learned that without the present invention in the form of partitioning wall 32, paint skin fragments and pieces of the paint skin can drop off into the volume of paint contained in container body 21. However, with partitioning wall 32 added as part of cap 22 and by designing the polyfoam liner 28 with a rough surface 29, the paint skin adheres to liner 28, at least that portion of the paint skin that is adjacent to the liner 28. The remainder of the paint skin adheres to the inside surface 43 of the container body 21. Since these two portions represented by broken lines 42*a* and 42*b* remain intact, there is nothing in the form of a fragmented piece of paint skin to come loose or drop off and enter the volume of paint contained with container body 21.

Figure 9:
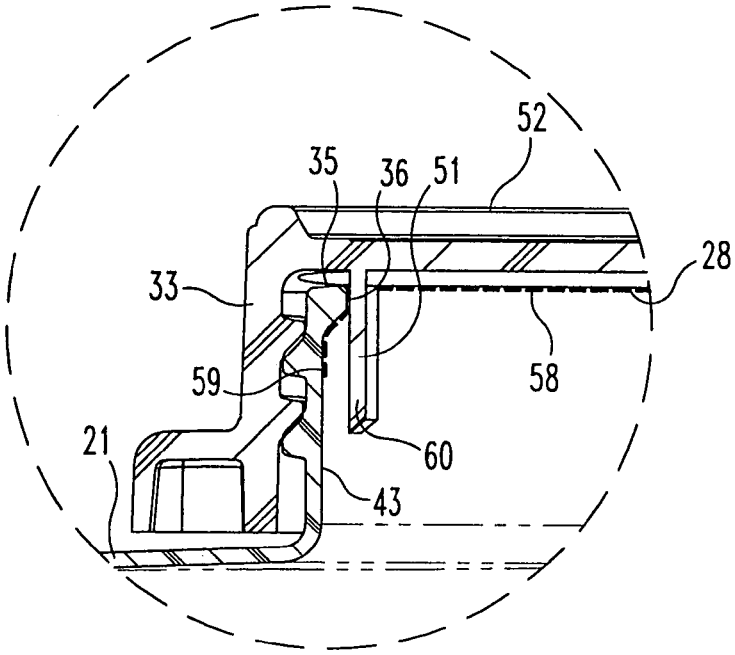
FIG. 9 is an enlarged, partial detail of the corresponding portion of the FIG. 7 paint container as identified in FIG. 7.
Figure 7:
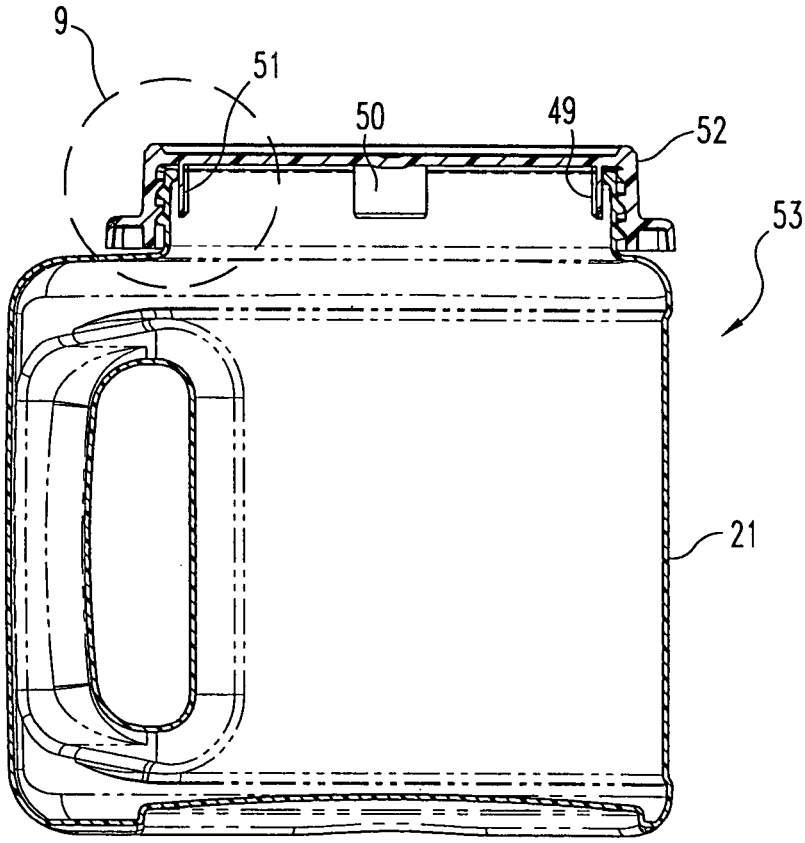
FIG. 7 is a side elevational view, in full section, of a paint container according to another embodiment of the present invention.
Figure 8:
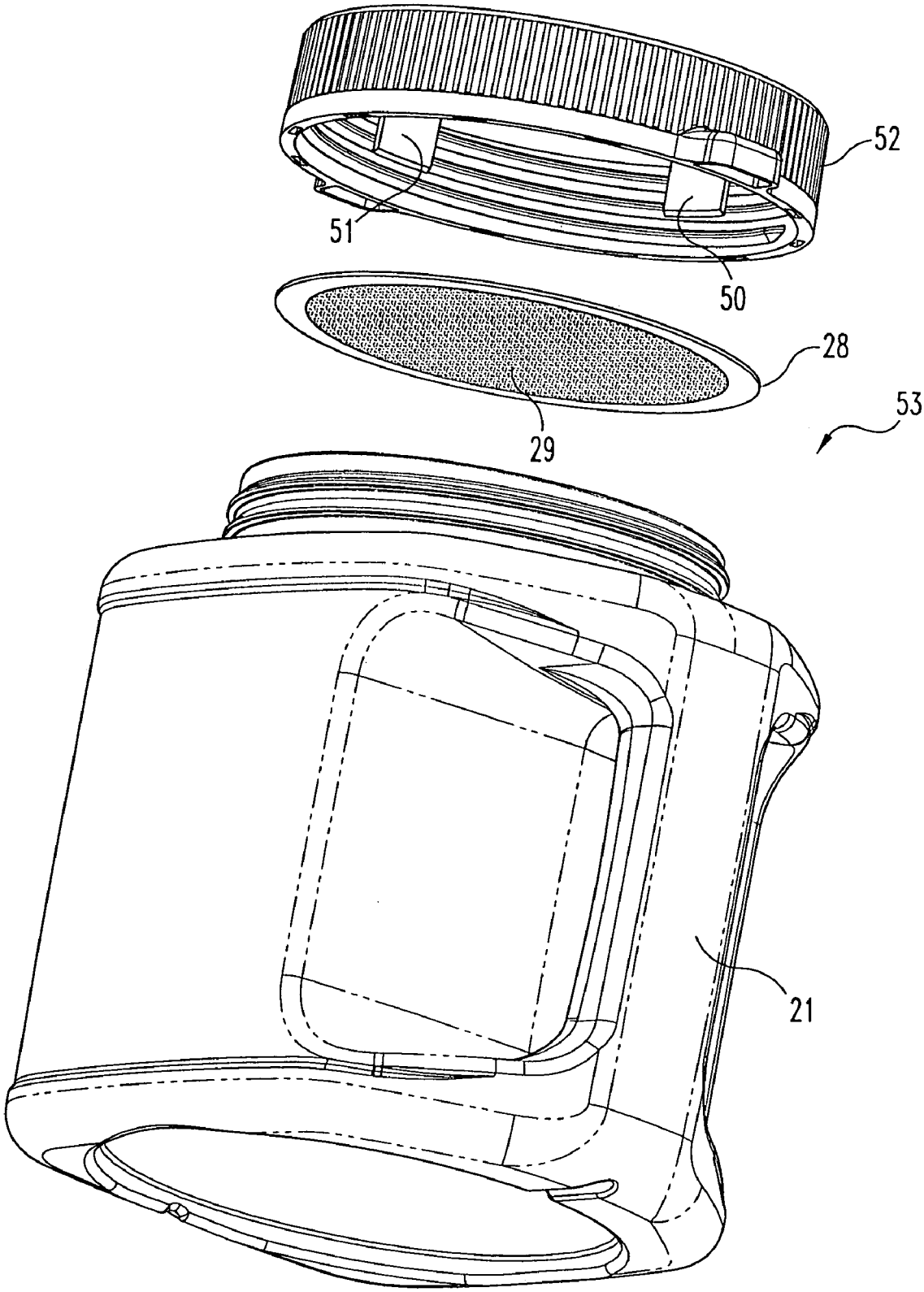
FIG. 8 is an exploded view of the FIG. 7 paint container.

Referring to FIGS. 7–9, a second embodiment of the present is illustrated in the form of three, equally-spaced apart cutting blades 49, 50 and 51. Each cutting blade is integrally molded as part of cap 52 and is axially extending and aligned with surface 36 of neck portion 23. The blow-molded, plastic paint container 53 illustrated in FIGS. 7–9 is identical in all respects to container 20, except for the differences between screw-on cap 22 and screw-on cap 52. Further, caps 22 and 52 are identical to each other in all respects, except for the differences between annular partitioning wall 32 and cutting blades 49–51. It should be noted though that these three cutting blades are positioned relative to surface 36 in exactly the same location as partitioning wall 32. These three cutting blades also extend axially for approximately the same distance down into neck portion 23 as partitioning wall 32. Due to the openings (spacing) between adjacent cutting blades, there are three paths that span the interface and extend between liner 28 of cap 52 and container body 21. These paths, equal in number to the number of blades, permit strips or panels of paint skin to form and thereby extend as part of a continuous paint skin from the liner 28 to neck portion 23.

While three equally-spaced cutting blades have been described, the actual number is selectable or optional, noting that any openings or clearance spaces left between adjacent cutting blades provides a path for a portion of the paint skin to bridge across and effectively connect the portion of paint skin adjacent to liner 28 and the portion of paint skin adjacent the inner surface of container body 21. With regard to the axial length of each cutting blade, specifically the length of each blade in the downwardly depending direction from the inner surface of the cap, this depends in part on the anticipated fluid level of the paint and specifically where the paint skin strips or panels are expected to form and the thread pitch of the cap and neck portion. The point to be made with regard to the depending axial length of each cutting blade is that, as the cap is unscrewed, these cutting blades move upwardly away from the location of the paint skin. It is important in considering the thread pitch and the axial length of each blade that whatever severing is required is performed before the blades move out of engagement with the paint skin strips or panels.

With three blades, it is only necessary to have blade-to-paint skin strip contact during approximately 120 degrees of retrograde rotation of the cap. This will ensure a full 360 degrees of severing action by the blades through the paint skin strips in order to sever the paint skin into two portions 58 and 59 as previously described. Since each blade 49–51 has a circumferential width, the arc length in degrees of the clearance space between adjacent cutting blades (when three are used), is actually something less than 120 degrees. As cap 52 is unscrewed, each cutting blade rotates into contact with its corresponding paint skin strip. Each cutting blade has a tapered or sharpened "leading" edge 60 that cuts through the referenced paint skin strip. The term "leading" as used in the context of edge 60 is based upon the direction of travel for each cutting blade as the cap 52 is unscrewed (i.e., retrograde rotation).

Once each paint skin strip is severed and cap 52 is removed from the container body 21, paint skin portion 58 adheres to liner 28 and is removed, intact, with the cap. The other paint skin portion 59 remains with the container body 21, adhering to the inside surface 43. By making a clean cut of the paint skin strips that extend between adjacent cutting blades, there are no paint skin fragments to come loose and drop off into the paint.

It is to be noted that while the number of cutting blades is a variable, their spacing is preferably equal so that the retrograde rotation is at most 360 divided by n, where "n" equals the number of cutting blades. It is also to be noted that the material selected for cap 52 and its integral cutting blades 49–51 (as well as partitioning wall 32) is a material to which the paint skin does not adhere.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A paint container comprising:

a container body defining a neck portion;

a closing cap constructed and arranged to be securable to said neck portion for closing said container body;

a liner assembled into said closing cap, said liner having an exposed surface, said exposed surface being textured; and partitioning means positionable between said neck portion and said liner for causing any paint skin that forms to be formed into two portions, one portion adjacent said liner and the other portion adjacent said container body.

2. The paint container of claim 1 wherein said neck portion is threaded and said closing cap is threaded, said closing cap being constructed and arranged for threaded assembly onto said neck portion.

3. The paint container of claim 2 wherein said partitioning means includes a depending annular wall.

4. The paint container of claim 1 wherein said partitioning means includes a depending annular wall.

5. A paint container comprising:

container body defining a neck portion;

a closing cap constructed and arranged to be securable to said neck portion for closing said container body;

a liner assembled into said closing cap, said liner having an exposed surface, said exposed surface being textured; and severing means forming a portion of said closing cap for segmenting a paint skin formed on the interior of said paint container into a container body skin portion and a closing cap skin portion, said severing means including at least one cutting blade.

6. A paint container comprising:

a container body defining a neck portion;

a closing cap constructed and arranged to be securable to said neck portion for closing said container body;

a liner assembled into said closing cap, said liner having an exposed surface, said exposed surface being textured; and severing means forming a portion of said closing cap for segmenting a paint skin formed on the interior of said paint container into a container body skin portion and a closing cap skin portion, said severing means including at least one cutting blade.

7. A paint container comprising:

a container body defining a neck portion;

a closing cap constructed and arranged to be securable to said neck portion for closing said container body;

a liner assembled into said closing cap, said liner having an exposed surface, said exposed surface being textured; and wherein said closing cap includes an integrally-molded partitioning wall that is constructed and arranged to be positioned between said neck portion and said liner for causing any paint skin that forms to be formed into two portions, one portion adjacent said liner and the other portion adjacent said container body.

8. A paint container comprising:

a container body defining a neck portion;

a closing cap constructed and arranged with an outer wall that is securable to said neck portion for closing said container body, said closing cap further including an integral depending annular wall, said depending annual wall being radially inward relative to said outer wall; and a liner assembled into said closing cap and being surrounded by said depending annular wall, said liner having an exposed surface, said exposed surface being textured.

9. A paint container comprising:

a container body defining a neck portion and a hollow interior for receiving a volume of paint;

a closing cap constructed and arranged with an outer wall that is securable to said neck portion for closing said container body, said closing cap further including an integral depending annular wall, said depending annular wall being radially inward relative to said outer wall; and a liner assembled to said closing cap, said liner being surrounded by said depending annular wall and having a textured surface that is directed at said volume of paint when said closing cap is secured to said neck portion; said textured surface having a material composition to which paint will adhere.

* * * * *